US006364606B1

(12) United States Patent
Rice et al.

(10) Patent No.: US 6,364,606 B1
(45) Date of Patent: Apr. 2, 2002

(54) HIGH TEMPERATURE CAPABLE FLANGE

(75) Inventors: Edward C. Rice; Jack D. Petty, both of Indianapolis, IN (US)

(73) Assignee: Allison Advanced Development Company, Indianapolis, IN (US)

( * ) Notice: Subject to any disclaimer, the term of this patent is extended or adjusted under 35 U.S.C. 154(b) by 0 days.

(21) Appl. No.: 09/708,826

(22) Filed: Nov. 8, 2000

(51) Int. Cl.[7] ..... F01D 9/00
(52) U.S. Cl. ..... 415/189; 415/213.1; 415/214.1
(58) Field of Search ..... 415/189, 190, 415/213.1, 214.1, 211.2

(56) References Cited

U.S. PATENT DOCUMENTS

| | | | | |
|---|---|---|---|---|
| 3,423,071 A | | 1/1969 | Noren | 253/78 |
| 3,861,827 A | | 1/1975 | Peabody et al. | 25/24 |
| 3,947,150 A | | 3/1976 | Lohonen | 415/219 R |
| 4,883,405 A | | 11/1989 | Walker | 415/137 |
| 4,890,978 A | | 1/1990 | McLaurin et al. | 415/209.4 |
| 5,118,253 A | | 6/1992 | Balkcum, III | 415/209.2 |
| 5,127,797 A | | 7/1992 | Carman | 415/209.2 |
| 5,180,281 A | | 1/1993 | Burge et al. | 415/209.2 |
| 5,211,536 A | | 5/1993 | Ackerman et al. | 415/177 |
| 5,222,360 A | | 6/1993 | Antuna et al. | 60/226.1 |
| 5,224,822 A | * | 7/1993 | Lenahan et al. | 415/189 |
| 5,249,921 A | | 10/1993 | Stueber et al. | 415/138 |
| 5,271,714 A | | 12/1993 | Shepherd et al. | 415/209.2 |
| 5,441,385 A | | 8/1995 | Boyd et al. | 415/209.2 |
| 5,618,161 A | | 4/1997 | Papageorgiou et al. | 415/190 |
| 5,701,733 A | | 12/1997 | Lewis et al. | 60/39.31 |
| 5,775,874 A | | 7/1998 | Boite et al. | 415/209.3 |
| 5,848,874 A | | 12/1998 | Heumann et al. | 415/189 |
| 5,868,553 A | | 2/1999 | Bättig et al. | 415/189 |
| 5,927,942 A | * | 7/1999 | Stahl et al. | 415/115 |
| 6,164,656 A | * | 12/2000 | Frost | 277/312 |

* cited by examiner

*Primary Examiner*—Edward K. Look
*Assistant Examiner*—Ninh Nguyen
(74) *Attorney, Agent, or Firm*—Woodard, Emhardt, Naughton, Moriarty & McNett

(57) ABSTRACT

A high temperature capable flange is disclosed where the use of bolts is minimized or eliminated. The flange is intended for use in a gas turbine engine extending generally along a central axis. The loads between a hanger and an inner case, a hanger and a seal, or between all three are transmitted through pin arrangements that are substantially radially located. The hanger, inner case and seal all include generally ring shaped portions that are at least partially overlapping. The ring shaped portions of the components may have a variety of radially overlapping cavities for receiving the pins in different arrangements.

18 Claims, 10 Drawing Sheets

HIGH TEMPERATURE CAPABLE FLANGE

BACKGROUND OF THE INVENTION

This invention generally pertains to a high temperature capable flange. In particular, various embodiments of the present invention relate to a boltless flange for use in turbo-machinery at the compressor discharge.

A gas turbine engine is typical of turbo-machinery in which the concept described herein may be advantageously employed. It is well known that a gas turbine engine conventionally comprises a compressor for compressing inlet air to an increased pressure for combustion in a combustion chamber. A mixture of fuel and the increased pressure air is burned in the combustion chamber to generate a high temperature gaseous flow stream for causing rotation of turbine blades within the turbine. The turbine blades convert the energy from the high temperature gaseous flow stream into kinetic energy, which is utilized to turn a propeller, fan, or other device. Further, the high temperature gaseous flow stream may be used directly as thrust for providing motive power, such as in a turbine jet engine.

A long recognized need by many gas turbine engine designers is to attain higher operating temperatures in order to achieve both a greater thermodynamic efficiency and an increase in power output per unit of engine weight. Theoretically, a gas turbine engine would operate at stoichiometric combustion in order to extract the greatest possible energy value from the fuel consumed. However, temperatures at stoichiometric and even near stoichiometric combustion are generally beyond the endurance capabilities of traditional metallic gas turbine engine components. Similarly, improvements to efficiency may result from increased pressure ratios in the compressor of the gas turbine engine. These increased pressure ratios result in higher compressor discharge temperatures which can be beyond the endurance capabilities of traditional metallic gas turbine engine components, such as bolts, found at the compressor discharge.

Many of the traditional flange designs for use in gas turbine engines make use of threaded fasteners such as screws and bolts. Such designs present difficulties in the high temperature environment encountered in gas turbine engines. As temperatures grow higher because of the desire for increased efficiency or because of increasing inlet temperatures associated with higher speed aircraft, existing bolt materials are found to be unsuitable. In particular, the compressor discharge temperatures are becoming greater than that allowed by traditional bolt materials. In the hostile environment of the gas turbine engine the bolt threading can seize up making disassembly, as may be necessary for repair, difficult if not impossible. Even more importantly, each thread of a bolt may act as a stress riser where fatigue and consequent fracture is more likely to occur.

Referring to FIG. 1 there is illustrated a configuration of an inner combustor case flange design. The illustrated inner combustor case flange design configuration comprises an inner case 110, hanger 120, outlet guide vane ("OGV") hanger 104, and OGV assembly 100 held together by a first series of bolts 170 spaced around the circumference of a first bolt circle. It should be understood that bolt 170 is actually one bolt in a larger bolt circle that is centered around a central axis. When the flange illustrated in FIG. 1 is used at the compressor discharge location, there will often be a compressor discharge pressure ("CDP") seal 140 that is attached to the OGV hanger 104 by a second series of bolts, such as bolts 180, spaced around the circumference of a second bolt circle.

Each of the bolts 170 in the first bolt circle has a shank 173 extending between a threaded end 171 and a head end 172 having head 172*a*. The shank 173 has a threaded portion 174 extending to the right of inner case 110 and is held in place by a locking nut 175 that has internal threading matching the external threading 174 on bolt 170. Similarly, each bolt 180 that is part of the second bolt circle has a shank 183 extending between a threaded end 181 and a head end 182 with a head 182*a*. The shank 183 has a threaded portion 184 that extends through the compressor discharge pressure seal 140 and the OGV hanger 104. Each bolt 180 is held in place by a locking nut 185 having an internal threading that matches the external threading of threaded portion 184 of bolt 180.

As illustrated in FIG. 1 the bolts 170, 180 engage locking nuts 175, 185 respectively which are attached to the right most flange of the assembly. Diametral locations of the five pieces (flanges) are controlled through a total of eight close tolerance pilot diameters and ten flange faces. Tangential orientation of the OGV assembly 100 is provided by a locating pin or a non-uniform bolt pattern in the flange.

There remains a need for flange designs capable of operating in high temperature environments. The present invention satisfies this need in a novel and nonobvious way.

SUMMARY OF THE INVENTION

The invention is a high temperature capable boltless flange for use in turbo-machinery. Instead of bolts, a plurality of substantially radially extending pins are used in the high temperature capable flange.

One embodiment of the invention is an apparatus for use in a gas turbine engine. The apparatus comprises a hanger, an inner case and a first pin. The hanger has a ring shaped portion substantially centered around an axis. The ring shaped portion of the hanger includes a first plurality of passages. Each of the first plurality of passages extends substantially radially with respect to the axis. The inner case has a ring shaped portion substantially centered around the axis. The ring shaped portion of the inner case is positioned radially outward from the ring shaped portion of the hanger. The ring shaped portion of the inner case includes a plurality of openings, each of the plurality of openings extending substantially radially with respect to the axis. At least one of the plurality of openings is substantially aligned with at least one of the first plurality of passages. A first pin extends between a first end and a second end. A first portion of the first pin and the first end are both positioned within said at least one of the plurality of openings. A second portion of the first pin is positioned within said at least one of the first plurality of passages to couple the hanger to the inner case.

Another embodiment of the apparatus of the present invention is an apparatus for use in a gas turbine engine comprising a hanger, a seal and a first pin. The hanger has a ring shaped portion substantially centered around an axis. The ring shaped portion of the hanger includes a first plurality of passages, each of the first plurality of passages extending substantially radially with respect to the axis. The seal has a ring shaped portion substantially centered around the axis, the ring shaped portion of the seal being positioned radially inward of the ring shaped portion of the hanger. The ring shaped portion of the seal includes a first plurality of orifices extending substantially radially with respect to the axis. At least one of the first plurality of orifices is substantially aligned with at least one of the first plurality of passages. A first pin extends between a first end and a second end. The first end and a first portion of the first pin are positioned within said at least one of the first plurality of passages. Also, a second portion of the first pin is positioned within said at least one of the first plurality of orifices to couple the hanger to the seal.

A third embodiment of the present invention is an apparatus for use in a gas turbine engine comprising a hanger, an inner case, a seal, means for coupling the hanger to the inner case and means for coupling the hanger to the seal. The hanger has a ring shaped portion substantially centered around an axis. The inner case has a ring shaped portion substantially centered around the axis. The ring shaped portion of the inner case is positioned radially outward of the ring shaped portion of the hanger. The seal has a ring shaped portion substantially centered around the axis. The ring shaped portion of the seal is positioned radially inward of the ring shaped portion of the hanger.

One object of the present invention is to provide a unique high temperature capable flange where the use of bolts is minimized or eliminated.

Related objects and advantages of the present invention will be apparent from the following description.

DESCRIPTION OF THE PREFERRED EMBODIMENTS

Figure 1:
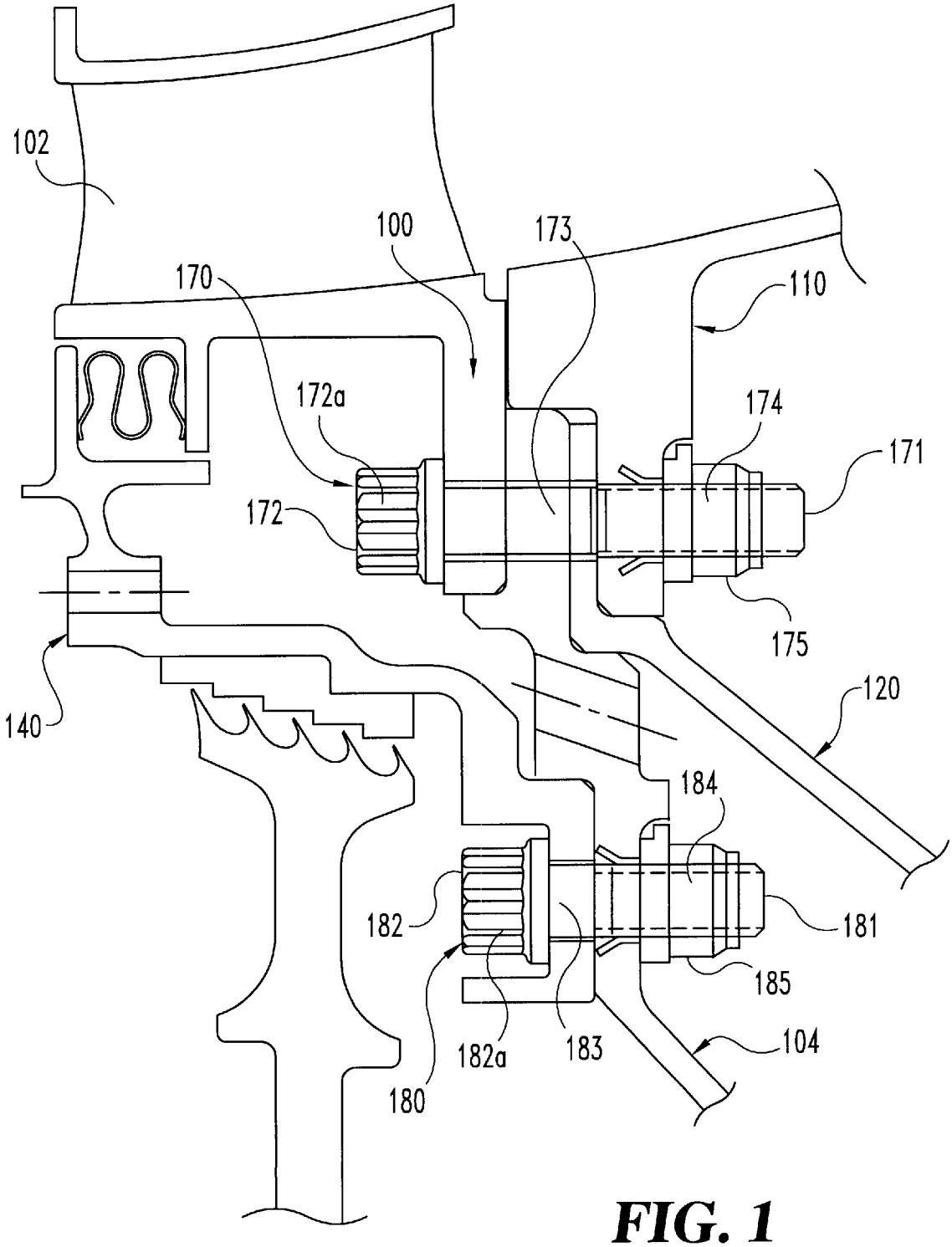
FIG. 1 (PRIOR ART)
FIG. 1 is a partial sectional view of an embodiment of a prior art inner combustor case flange design.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
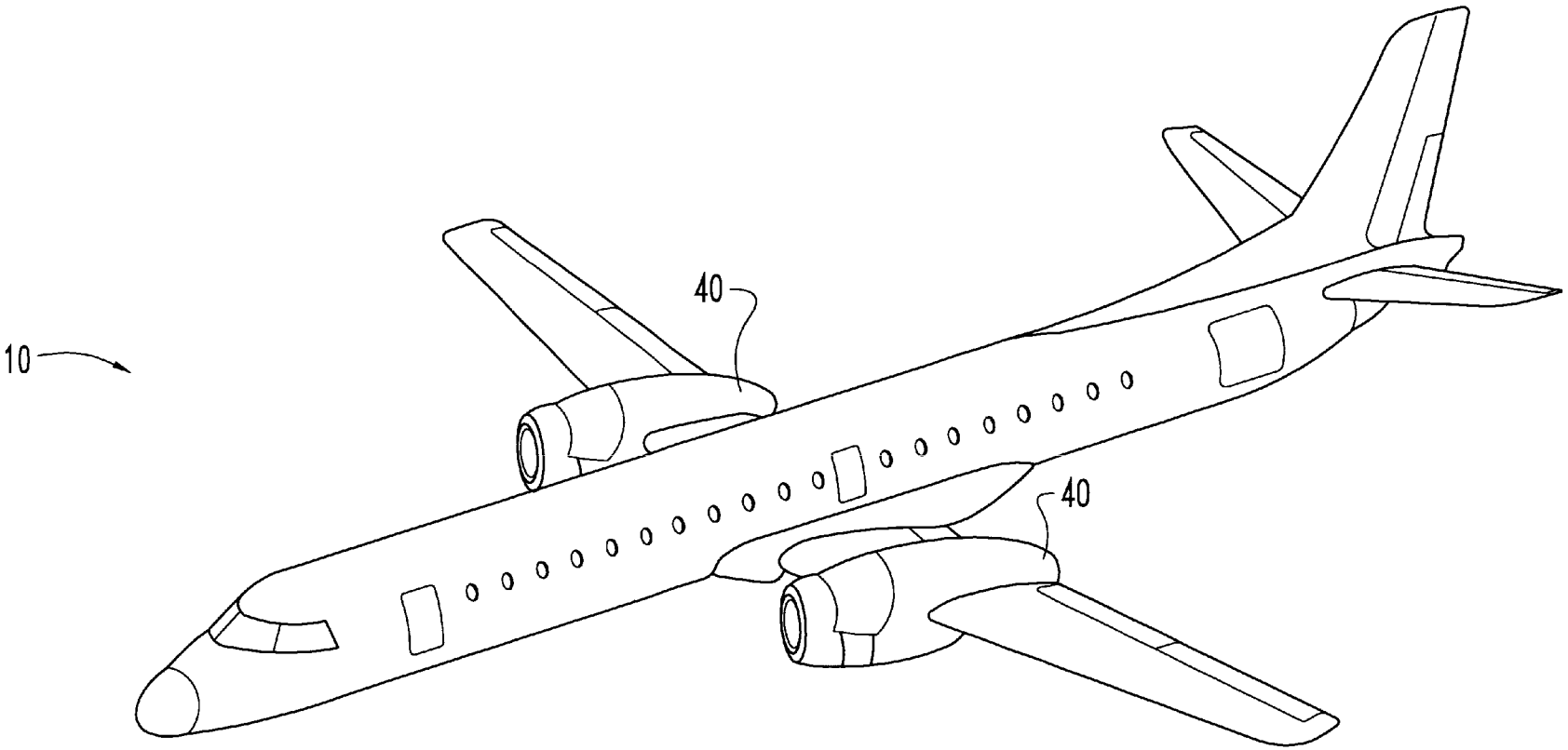
FIG. 2 is a perspective view of a generic aircraft powered by a gas turbine engine.

Referring to FIG. 2, there is illustrated a generic aircraft 10 having gas turbine engines 40. The term aircraft is generic and includes helicopters, airplanes, missiles, unmanned space devices and any other substantially similar devices.

Figure 3:
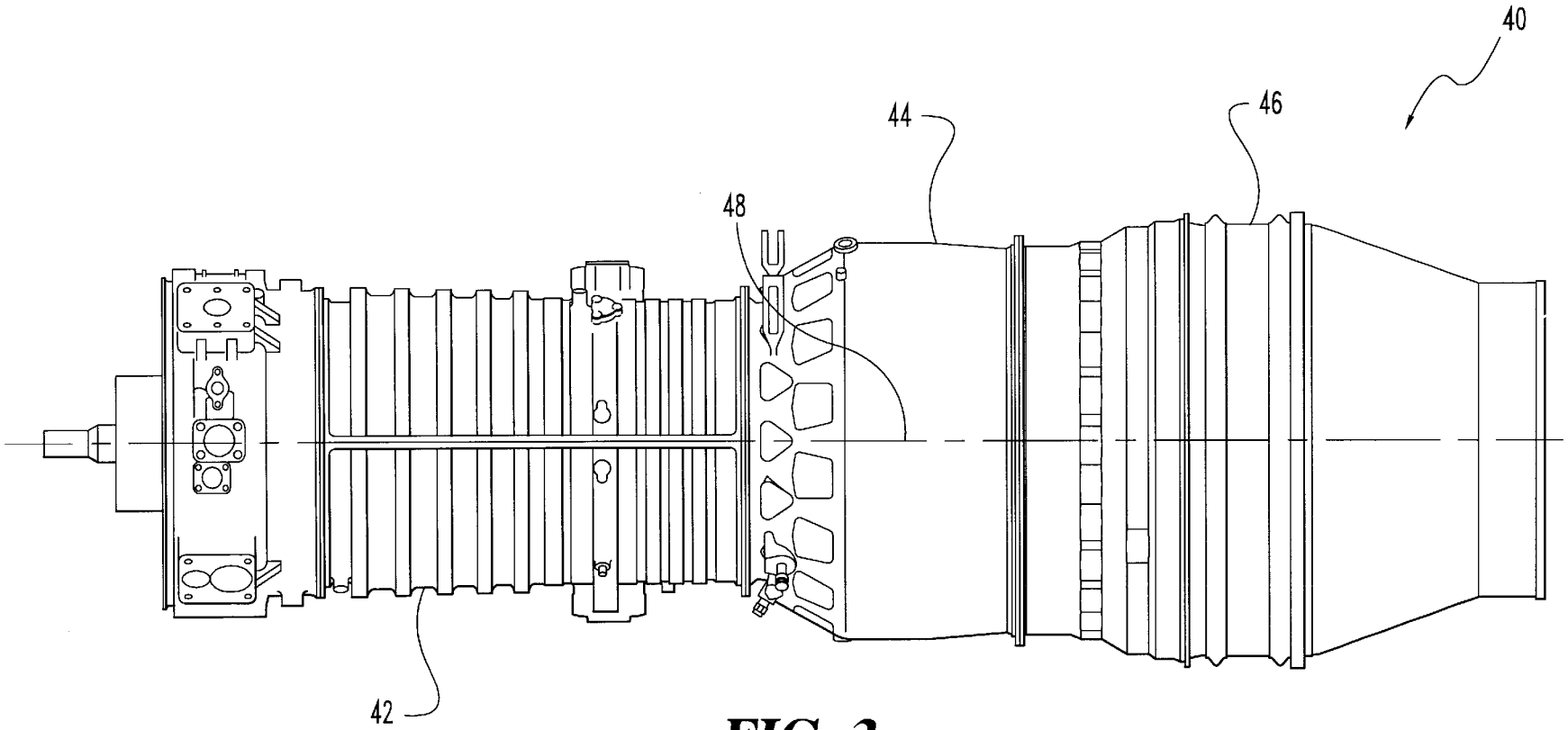
FIG. 3 is a side view of the gas turbine engine of FIG. 2.

Referring to FIG. 3 there is illustrated a gas turbine engine 40 extending generally along a center line 48. The gas turbine engine 40 includes a compressor 42, a combustor 44, and a turbine 46. The three components have been integrated together to produce an aircraft flight engine. It is important to realize that there are a multitude of ways in which the gas turbine engine components can be linked together. Additional compressors and turbines could be added with intercoolers connecting between the compressor, and reheat combustion chambers could be added between the turbines. A gas turbine engine is also generally suited to be used for a variety of industrial applications. Historically, there has been widespread application of industrial gas turbine engines, such as pumping sets for gas and oil transmission lines, electrical generation, and naval propulsion.

Figure 4:
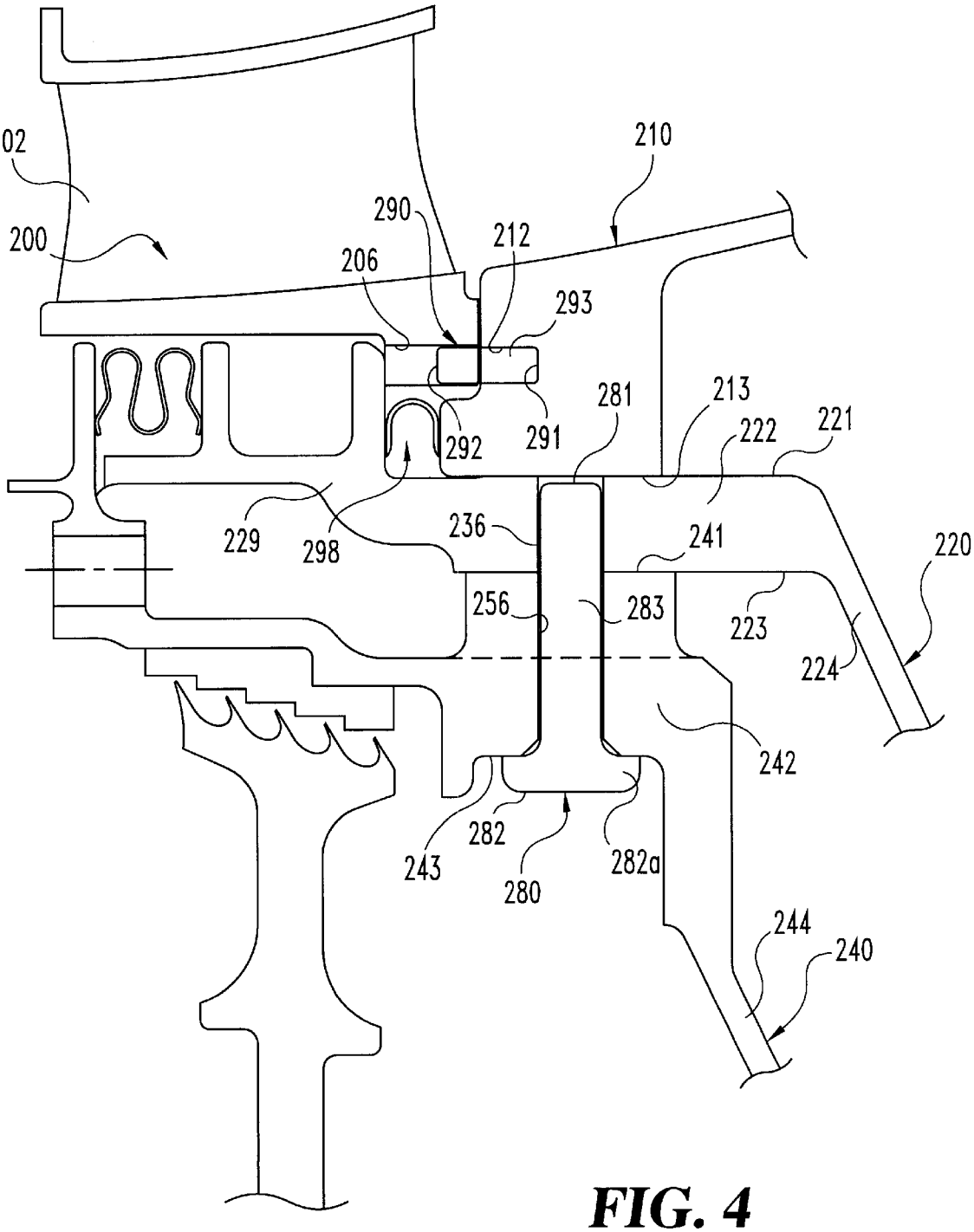
FIG. 4 is a partial sectional view of an embodiment of the flange of the present invention.
Figure 5:
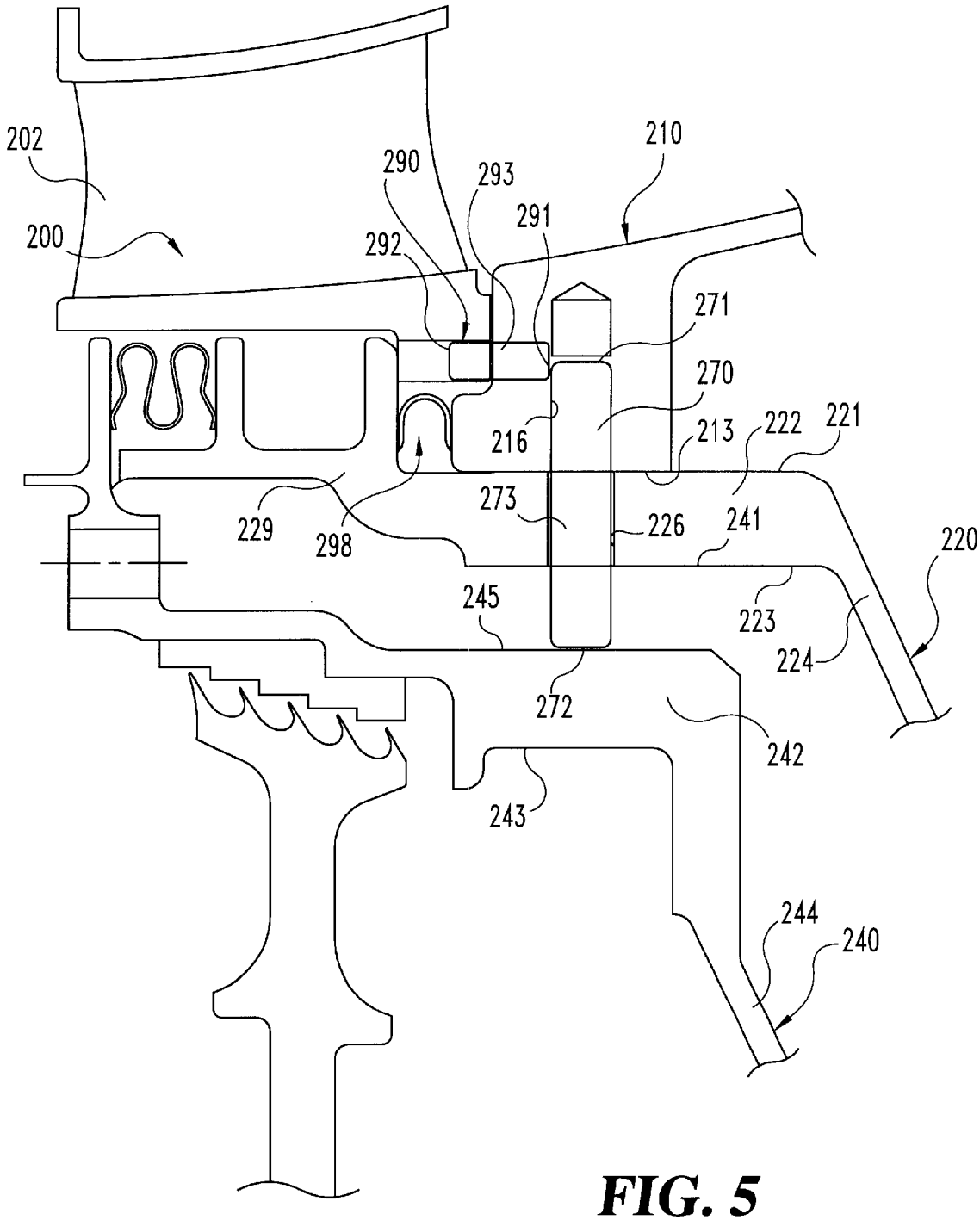
FIG. 5 is a partial sectional view of the embodiment of FIG. 4 with a different pin rotated into the plane.

Referring to FIGS. 4–8 there is illustrated one embodiment of the flange of the present invention and its assembly. As illustrated in FIGS. 4 and 5 this embodiment of the flange of the present invention includes an inner case 210, hanger 220, compressor discharge pressure seal 240, and OGV assembly 200. The four pieces (inner case 210, hanger 220, compressor discharge seal 240 and OGV assembly 200) are held together by substantially radially located pins. It should be understood that in the preferred embodiment the four pieces are held together by two pluralities of radially located pins 270, 280 spaced around the circumference of the ring shaped portion of the various components as discussed further below. In each embodiment it should be understood that while the description may refer to a single pin, in the preferred form there are a plurality of pins inserted through or into various cavities defined in the components.

Referring to FIGS. 4 and 5 the hanger 220 has a substantially radially extending portion 224 and a ring shaped portion 222. The hanger 220 preferably has an extension 229 that forms a land for the seal 298 positioned between the inner case 210 and hanger 220 to minimize leakage across that diametral interface. The ring shaped portion 222 of the hanger 220 includes a first plurality of passages 226 (see FIG. 5) preferably extending through the entirety of the radial thickness of the hanger 220 between the radial outer face 221 and radial inner face 223. The ring shaped portion 222 of hanger 220 also preferably includes a second plurality of passages 236 (see FIG. 4) extending substantially radially from radial inner face 223 toward radial outer face 221. In a preferred form the second plurality of passages 236 extends all the way through the radial thickness of hanger 220.

Referring again to FIGS. 4 and 5, the compressor discharge pressure seal 240 has a substantially radially extending portion 244 and a ring shaped portion 242. The ring shaped portion 242 of the compressor discharge pressure seal 240 preferably includes a plurality of orifices 256 preferably extending through the entirety of the radial thickness of the compressor discharge pressure seal 240 between the radial outer face 241 and the radial inner face 243.

The inner case 210 includes a plurality of openings 216 that extend substantially radially outward from the radial inner face 213 of the inner case 210 but preferably do not extend through the entire radial thickness of the inner case 210. The inner case 210 also includes at least one and preferably a plurality of axially extending apertures 212. The OGV assembly 200 includes an outlet guide vane 202. The OGV assembly 200 also includes at least one and preferably a plurality of axially extending bores 206.

The pins 270, 280 couple the above described components together. Each first pin 270 has a shank 273 extending between a first end 271 and a second end 272. The second pin 280 has a shank 283 extending between a first end 281 and a second end 282. The second end 282 preferably has a head 282*a*.

Briefly, before discussing the coupling of various components and the arrangement of the first and second plurality of radially extending pins, it should be noted that there is preferably a third plurality of pins 290 that provide tangential orientation for the OGV assembly 200 and transmit torsion loads to the inner case 210. By tangential orientation it should be understood that, in FIGS. 4 and 5, the various components load one another axially (to the left and to the right in the plane of the page). Tangential orientation is in the plane going in and out of the page. The plurality of third pins 290 each have a shank 293 extending between the first end 291 and the second end 292. The first end 291 is received in the aperture 212 formed in inner case 210. The second end 292 of the third pin 290 is received in the bore 206 formed in OGV assembly 200.

Referring again to FIGS. 4–5 various details concerning the alignment of various components are illustrated. With reference to FIG. 4 there is illustrated a view of one embodiment of the present invention where second pin 280 is in the plane of the drawing and first pin 270 (not illustrated in FIG. 4) is rotated out of the plane of the drawing. With reference to FIG. 5, a different sectional view is illustrated, the embodiment of the present invention of FIG. 4 having been rotated so that first pin 270 is illustrated in the plane of the figure.

The first plurality of passages 226 of hanger 220 include at least one passage 226 that is substantially aligned with at least one opening 216 of the plurality of openings 216 of the inner case 210. It should be understood that in the preferred embodiment preferably all of the plurality of openings 216 of inner case 210 will be substantially radially aligned with all of the first plurality of passages 226 of hanger 220. The second plurality of passages 236 preferably extend all the way through the radial thickness of the hanger 220 in the preferred form. In one embodiment the second plurality of passages 236 of hanger 220 include at least one passage 236 that is substantially radially aligned with at least one of the second plurality of orifices 256 of compressor discharge pressure seal 240. It should be understood that in the preferred embodiment preferably all of the second plurality of passages 236 of hanger 220 will be substantially radially aligned with all of the second plurality of orifices 256 of compressor discharge pressure seal 240. Thus it should be understood that the inner case 210 is preferably coupled to the hanger 220 by the plurality of first pins 270 and the hanger 220 is preferably separately coupled to the compressor discharge pressure seal 240 by the plurality of second pins 280. In one form the first plurality of passages 226, preferably, but not necessarily, extend all the way through the radial thickness of the hanger 220.

Figure 6:
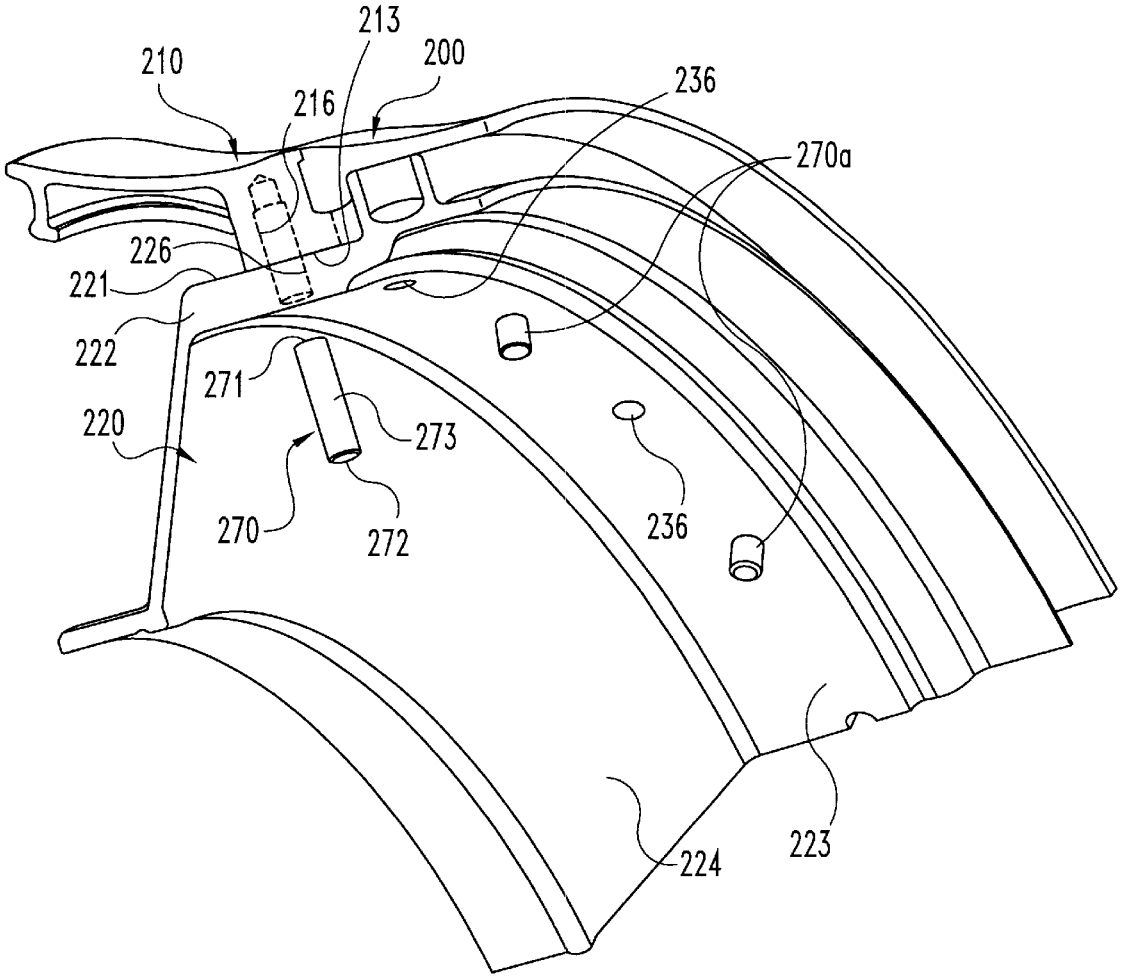
FIG. 6 is a perspective view showing a partially assembled portion of the embodiment of FIG. 4.

Referring again to FIGS. 4–8, having briefly described general features of various components, further details of the first and second plurality of pins, and how they are received in the various cavities to couple the components and/or transmit loads, will now be discussed. With reference to FIGS. 5 and 6 there is illustrated the assembly of the preferred form of one embodiment of the present invention. The first end 271 of first pin 270 is inserted through the first passage 226 extending between radial outer face 221 and radial inner face 223 of hanger 220 until the first end 271 is positioned within opening 216 of inner case 210. When any first pin 270 is fully installed, such as pins 270*a* (see FIG. 6), the shank 273 of each pin preferably has a length such that the second end 272 of fully installed pins 270*a* is positioned radially inward of the radial inner face 223 of the ring shaped portion 222 of hanger 220. The second end 272 of first pin 270 is then preferably retained by surface 245 of the compressor discharge pressure seal 240.

Figure 7:
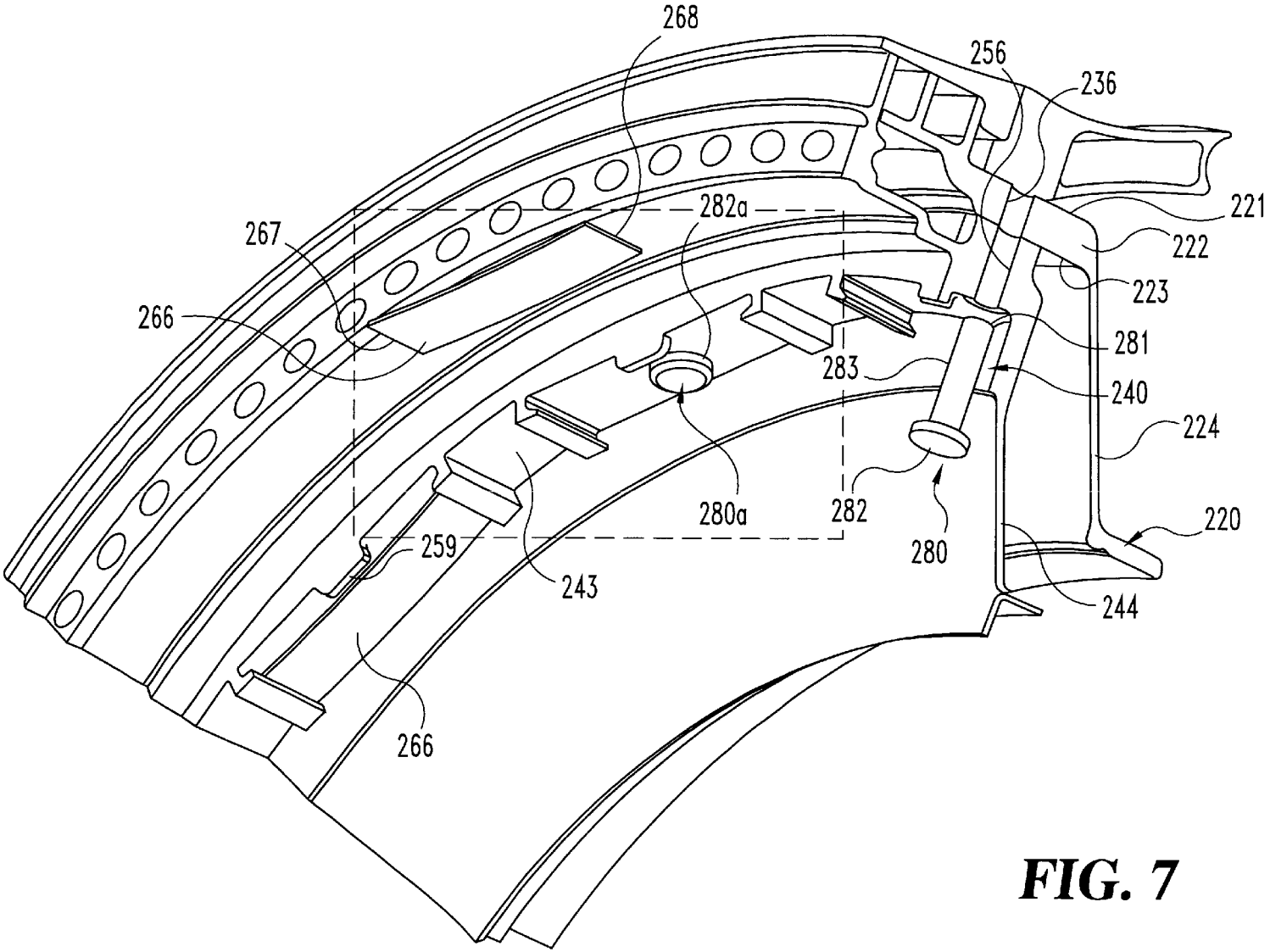
FIG. 7 is a perspective view showing a further assembled portion of the embodiment of FIG. 6.
Figure 8:
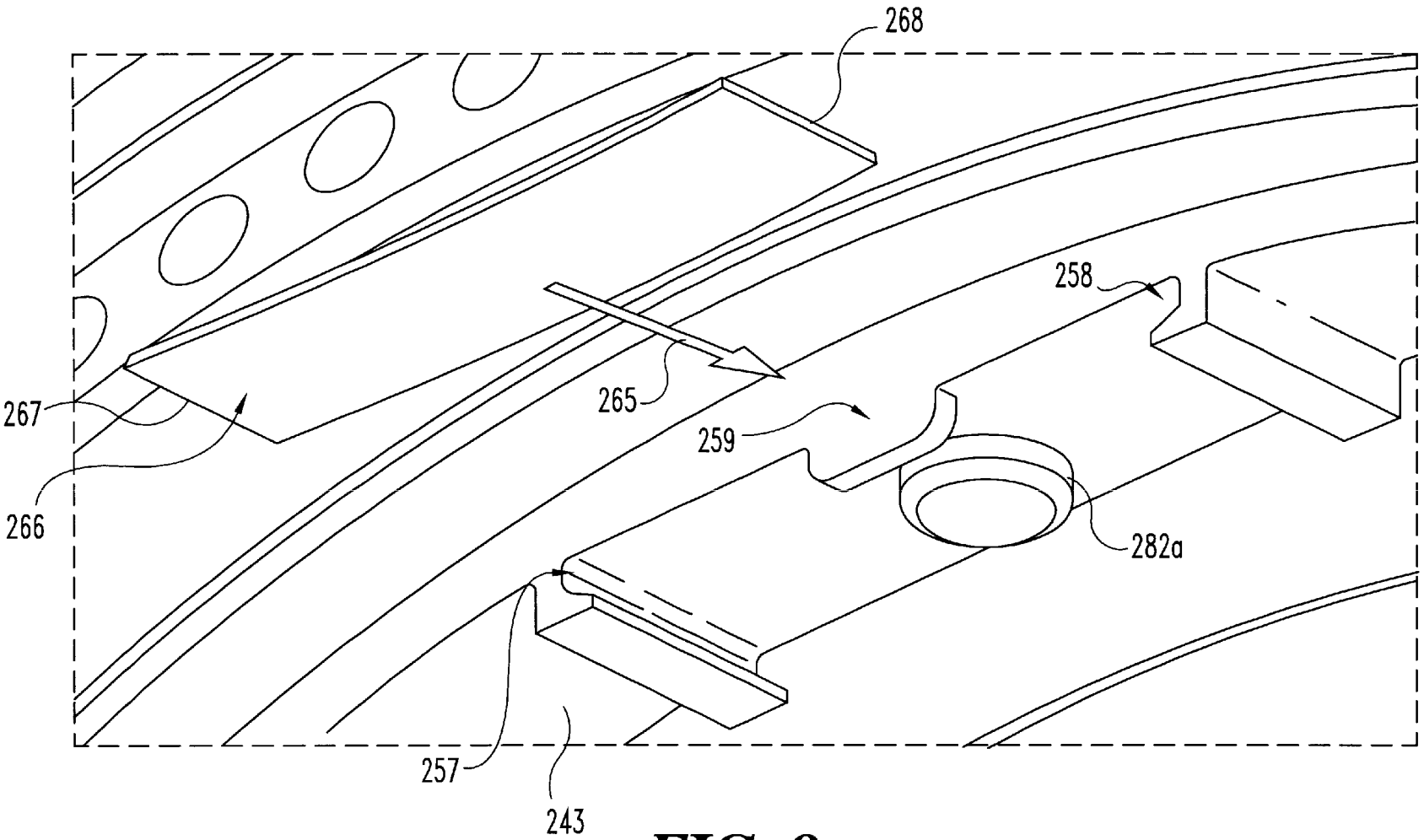
FIG. 8 is a close up view of a portion of FIG. 7.

With reference to FIGS. 4, 7 and 8 there is illustrated the assembly of the compressor discharge pressure seal 240 to the hanger 220. The plurality of second pins 280 are inserted as will now be described. The first end 281 of second pin 280 is inserted through the orifice 256 extending between radial outer face 241 and radial inner face 243 of compressor discharge pressure seal 240 until the first end 281 of second pin 280 is retained within the second passage 236 of hanger 220. Both uninstalled second pins 280 as well as installed second pins 280*a* are illustrated in FIG. 7.

To aid in retaining second pin 280 there is preferably a retaining clip which is a strip of material 266 extending between a first end 267 and a second end 268. As illustrated more clearly in FIG. 8, after the second pin 280 has been fully installed, the head 282*a* of the second end 282 of the second pin 280 protrudes slightly radially inward of the radial inner face 243 of the ring shaped portion 242 of compressor discharge pressure seal 240. A pair of retainers, such as slots 257, 258, are formed on the radial inner face 243 surrounding each orifice 256. The first slot 257 receives the first end 267 and the second slot 258 receives the second end 268 of strip 266. The arrow 265 (see FIG. 8) shows the respective ends 267, 268 of strip 266 being inserted into the pair of slots 257, 258. The strip 266 preferably snaps over a lip 259 formed in the radial inner face 243 near the orifice 256 of compressor discharge pressure seal 240 where the head 282*a* of second pin 280 protrudes radially inward.

Further details, while apparent from the figures, will be discussed briefly. In one preferred embodiment the plurality of first pins 270 and the plurality of second pins 280 are inserted into cavities created by a line drilling operation between the inner case 210 and hanger 220 as well as between the hanger 220 and compressor discharge pressure seal 240. As previously mentioned, the seal 298 is added between the inner case 210 and the hanger 220 to minimize leakage across that diametral interface. While the plurality of third pins 290 provide tangential orientation for the OGV assembly 200 and transmit torsion loads to the inner case 210, it should be understood that all other loads are preferably transmitted through the plurality of first pins 270 and plurality of second pins 280 through the cross key arrangement.

In one form the cross key arrangement includes a plurality of pins oriented substantially normal to the centerline of the combustor. The pins pass through concentric flange faces which are concentric with a combustor centerline. One end of each pin is secured to each flange and allowed to float relative to the flange. During operation of the engine, one of the flanges may be subjected to different thermal conditions. As one flange enlarges because of thermal conditions with respect to the other flange, the other flange moves along the pins radially thereby allowing the transfer of torsional loads without transferring any significant thermal loads to either flange.

FIGS. 6–8 illustrate various details regarding the assembly of one embodiment of the present invention. FIG. 6 illustrates the hanger 220 being assembled to the inner case 210 preferably through a plurality of first pins 270 that are spaced apart from one another circumferentially around the ring shaped portion 222 of the hanger 220. In one preferred embodiment the plurality of first pins 270 is fourteen in number. As illustrated in FIG. 6, a fully installed first pin 270*a* has a second end 272 that preferably extends radially inward of the radial inner face 223 of the ring shaped portion of 222 of hanger 220. FIG. 7 illustrates the compressor discharge pressure seal 240 assembled to the hanger 220. The compressor discharge pressure seal 240 retains a plurality of second pins 280 having heads 282*a*. In one preferred embodiment of the present invention, the compressor discharge pressure seal 240 installed within the hanger 220 is retained through fourteen second pins 280 having heads 282*a*. It should be understood that the exemplary number of fourteen pins in the first or second plurality of pins is not intended to be limiting and variations in this number are contemplated as within the scope of the invention.

The plurality of second pins 280, as discussed above, are received within a plurality of second orifices 256 in the compressor discharge pressure seal 240 and a plurality of second passages 236 in the hanger 220. The primary retention mechanism for the plurality of first pins 270 and the plurality of second pins 280 is provided by a press fit or loose fit between the shanks 283, 273 of the pins 280, 270 respectively and the various cavities in the inner case 210, hanger 220 and compressor discharge pressure seal 240. The shank 283 of the second pin 280 is preferably retained by a press fit within the second plurality of orifices 236 of hanger 220 and by a loose fit within the plurality of second passages 256 of compressor discharger pressure seal 240. The shank 273 of the first pin 270 is preferably retained by a press fit within the plurality of openings 216 of the inner care 210 and by a loose fit within the first plurality of passages 226 of hanger 220. It should be understood by those of ordinary skill in the art that a "loose fit" is generally only a couple of thousandths of an inch different from a press fit and that the distances between the shank and the walls of a cavity have been exaggerated in the figures. In a preferred form of the present invention the press fit has an interference of about 0.0005 inches to about 0.001 inches, however, other press fit interferences are contemplated herein. The necessity for a loose fit arises from the manufacturing tolerances of aligning one cavity with another making it preferable to have one cavity slightly larger than the other. The previously mentioned line drilling for creating the cavities is one preferred mechanism for obtaining the desired fit. Line drilling is a machining process used to form two sets of holes in two separate parts in a single operation. In one form the two parts are positioned together and retained in a fixture and a hole is then drilled through both parts as they are held together. The drilling operation can be followed by post drilling operations such as reaming. A backup mechanism for retaining the plurality of second pins 280 is provided by the clip in the form of strip 266 that slides into the pair of slots 257, 258 and snaps over the lip 259.

Figure 9:
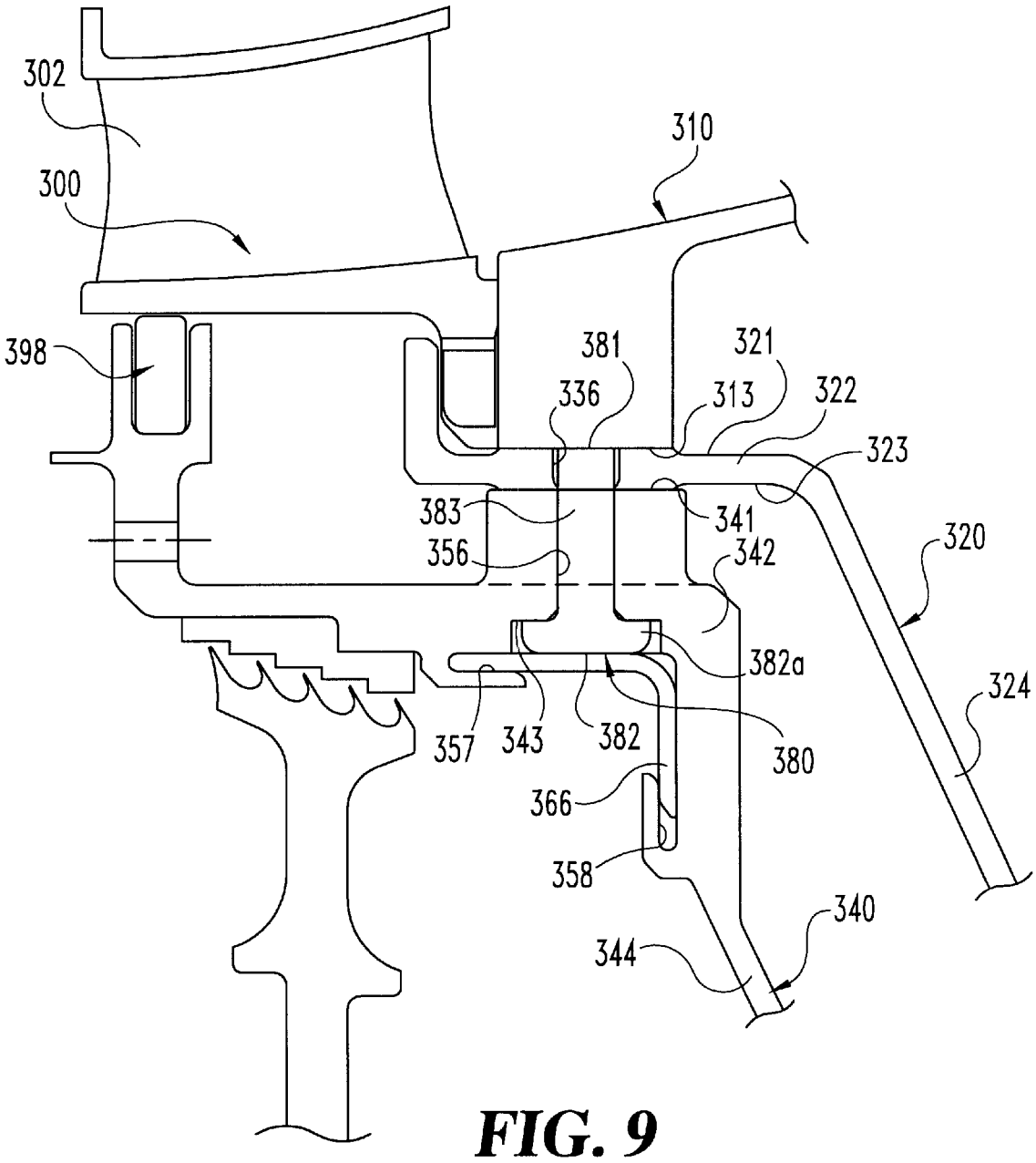
FIG. 9 is a partial sectional view of a second embodiment of the flange of the present invention.
Figure 10:
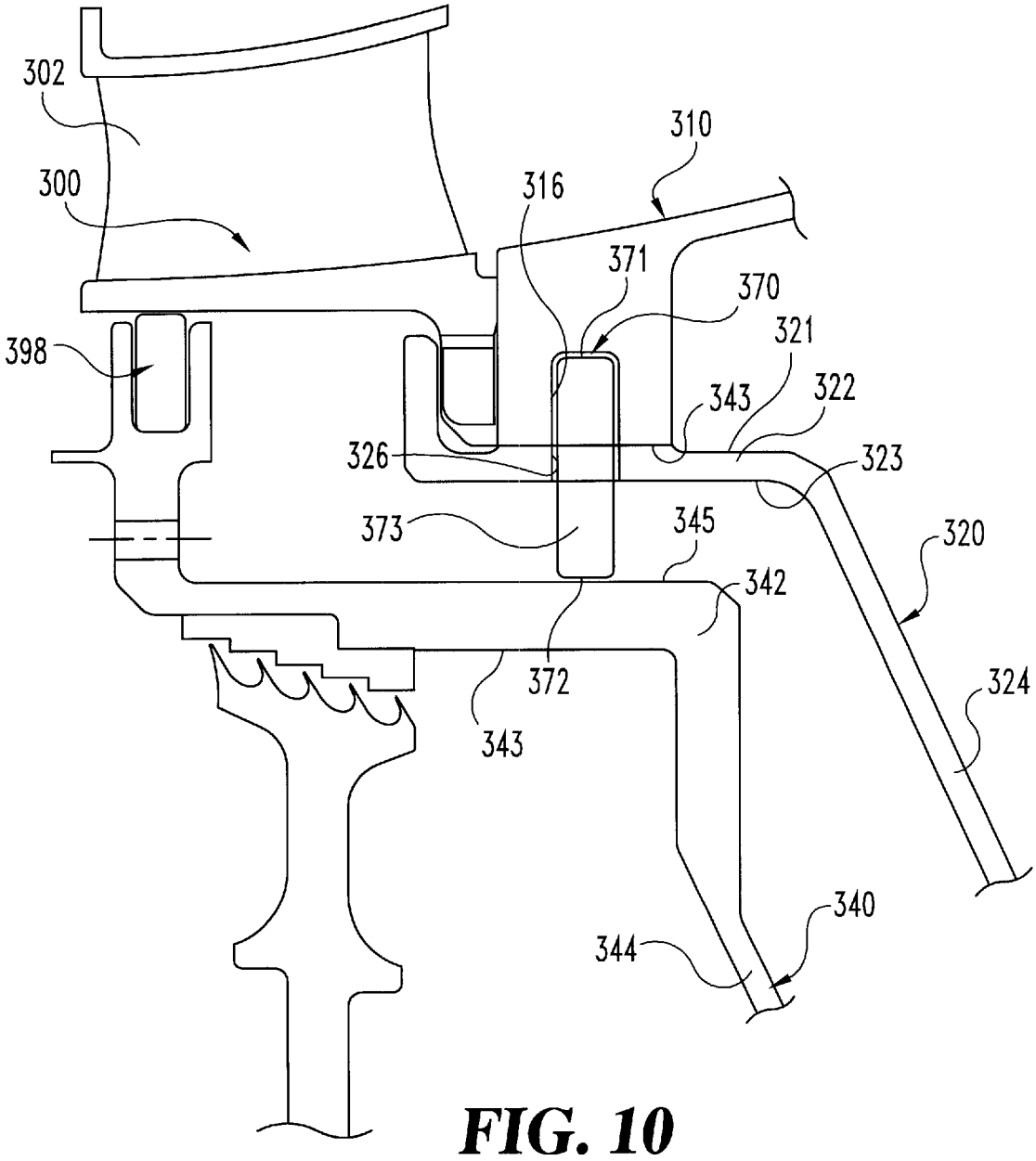
FIG. 10 is a partial sectional view of the embodiment of FIG. 9 with a different pin rotated into the plane.

With reference to FIGS. 9–10 there is shown a second embodiment of a high temperature capable flange design consisting of an inner case 310, hanger 320, compressor discharge pressure seal 340 and OGV assembly 300. As is illustrated in FIGS. 9–10 the OGV assembly 300 includes an outlet guide vane 302. As in the first embodiment the four components are preferably held together through a plurality of first pins 370 and a plurality of second pins 380, both of which extend substantially radially.

Referring to FIG. 10, the hanger 320 has a ring shaped portion 322 and a generally radially extending portion 324. The hanger 320 includes a plurality of substantially radially extending first passages 326 between the radial outer face 321 and radial inner face 323 of the ring shaped portion 322. The plurality of first passages 326 are preferably adapted to receive a portion of the first pin 370. The first pin 370 has a shank 373 extending between a first end 371 and a second end 372. The first end 371 will preferably be retained in the substantially radially extending opening 316 defined in the inner case 310. The ring shaped portion 322 of the hanger 320 also defines a second plurality of substantially radially extending passages 336 (see FIG. 9).

Referring again to FIG. 10, the compressor discharge pressure seal 340 has a ring shaped portion 342 and a generally radially extending portion 344. In the preferred embodiment the plurality of openings 316 in inner case 310 will be substantially radially aligned with the first plurality of passages 326 in hanger 320. The first end 371 of each first pin 370, as mentioned above, is retained in the opening 316 and the second end 372 is preferably retained by the outward radial surface 345 of the compressor discharge pressure seal 340.

Referring to FIG. 9, each of the plurality of second pins 380 has a shank 383 extending between a first end 381 and a second end 382. The second end 382 preferably has a head 382*a* formed thereon. The compressor discharge pressure seal 340 also includes a plurality of substantially radially extending orifices 356 extending through the radial thickness of ring shaped portion 342 between radial outer face 341 and the radial inner face 343. The plurality of orifices 356 in compressor discharge pressure seal 340 is preferably substantially radially aligned with the second plurality of passages 336 in hanger 320. The first end 381 of each of the second pins 380 is retained within the second plurality of passages 336 with the shank 383 extending through the plurality of orifices 356 such that the head 382*a* protrudes radially inward from the radial inner face 343 of the compressor discharge pressure seal 340. As with the previously described embodiment the first plurality of pins 370 and the second plurality of pins 380 are preferably press fit between the shank of the respective pin and at least one of the cavities in the various components. Again, as in the first embodiment, a backup means for retaining the second pin 380 is present. In this embodiment the backup means is provided by a strip 366 which is a L shaped bracket which slides into a pair of retainers, such as slots 357, 358 defined on the radial inner face 343 of the compressor discharge pressure seal 340. The L shaped bracket preferably snaps over a lip (not shown).

As with the previous embodiment a third pin (not illustrated) provides tangential orientation for the OGV assembly 300 and transmits torsion loads to the inner case 310. Note that in this embodiment the hanger 320 has a thinner cross section and preferably does not transmit the compressor discharge pressure seal 340 load out to the inner case 310. This embodiment of the invention also does not include the extension 229 of the hanger 220 that forms a land for the seal 298 in the first embodiment. Instead the seal 298 is replaced with a piston type seal 398.

It should be understood that all of the terms used to describe the various cavities such as passages, orifices, openings, apertures, bores etc. are intended to be interchangeable with one another. It should be further understood that in various embodiments the cavities being described by these terms may extend through a portion, or the entirety of the radial thickness of the various components as preferred. It should also be understood that, while the various cavities are depicted and described as spaced equally around the entirety of the circumference of various components, other embodiments are contemplated as within the scope of the invention wherein the cavities are only around a portion of the circumference of the component and/or are irregularly spaced apart from one another. Additionally, while the preferred embodiment of the flange of the present invention has been described for use at the compressor discharge, application of the present invention at other locations within the gas turbine engine is contemplated as within the scope of the invention.

It should be understood that all of the designs of the present invention either allow the reduction or elimination of use of bolts and instead preferably transmit loads through a variety of pin arrangements. Additionally, in all embodiments of the present invention at least one of the pins being used extends substantially radially with respect to the axis along which the gas turbine engine components extend as opposed to axially. The use of a radial, as opposed to axial pin, results in the load being in shear as opposed to tensile as would be the case for an axially aligned bolt of the flanges of the prior art. Thus, the pins are preferably not preloaded. As a result of the design of the various embodiments of the present invention the load may pass through a neutral body with a higher strength than that of bolts. This means that fewer pins are necessary than bolts to provide the same strength or an equal number of pins may be used to provide greater strength. It should also be understood that while the surface geometry of the pins is illustrated as substantially smooth, such is merely exemplary and other surface geometries such as roughened or knurled are contemplated as within the scope of the invention.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. In reading the claims it is intended that when words such as "a", "an", "at least one", "at least a portion" are used there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. An apparatus for use in a gas turbine engine, comprising:

a hanger having a ring shaped portion substantially centered around an axis, the ring shaped portion of the hanger including a first plurality of passages, the first plurality of passages extending substantially radially with respect to the axis;

an inner case having a ring shaped portion substantially centered around the axis, the ring shaped portion of the inner case positioned radially outward from the ring shaped portion of the hanger, the ring shaped portion of the inner case including a plurality of openings, the plurality of openings extending substantially radially with respect to the axis, wherein at least one of the plurality of openings is substantially aligned with at least one of the first plurality of passages; and, a first pin extending between a first end and a second end, a first portion of the first pin and the first end both positioned within said at least one of the plurality of openings and a second portion of the first pin positioned within said at least one of the first plurality of passages to couple the hanger to the inner case.

2. The apparatus of claim 1, further comprising:

a seal having a ring shaped portion substantially centered around the axis, the ring shaped portion of the seal positioned radially inward of the ring shaped portion of the hanger, the ring shaped portion of the seal including a plurality of orifices extending substantially radially with respect to the axis; and, a second pin extending between a first end and a second end;

wherein the ring shaped portion of the hanger includes a second plurality of passages, the second plurality of passages extending substantially radially with respect to the axis, at least one of the second plurality of passages being substantially aligned with at least one of the plurality of orifices; and, wherein the first end and a first portion of the second pin are both positioned within said at least one of the second plurality of passages and a second portion of the second pin is positioned within said at least one of the plurality of orifices to couple the seal and the hanger together.

3. The apparatus of claim 2, wherein the ring shaped portion of the seal includes a pair of slots for receiving a strip to retain the second pin.

4. The apparatus of claim 3, wherein the strip is substantially L-shaped.

5. The apparatus of claim 3, wherein the seal further includes a lip to retain the strip, the lip being located between the pair of slots.

6. The apparatus of claim 2, wherein the second end of the second pin protrudes radially inward from said at least one of the plurality of orifices, the second end of the second pin having a head.

7. The apparatus of claim 2, further comprising an outlet guide vane assembly positioned radially outward of the hanger and coupled to the inner case.

8. The apparatus of claim 7, wherein the outlet guide vane assembly includes a bore extending substantially parallel to the axis, and wherein the inner case includes an aperture extending substantially parallel to the axis, and wherein the aperture is substantially aligned with the bore; and, a third pin positioned within the bore and the aperture to transmit torsion loads from the outlet guide vane assembly to the inner case.

9. The apparatus of claim 7, wherein the hanger includes an extension that forms a land to support a seal between the outlet guide vane assembly and the hanger.

10. The apparatus of claim 1, wherein the first pin is one of a plurality of first pins, each first pin extending between a first end and a second end, each of the plurality of openings being substantially aligned with a corresponding one of the first plurality of passages, the first end and a first portion of each first pin positioned within one of the plurality of openings and a second portion of each first pin extending through said corresponding one of the first plurality of passages and the second end and a third portion of the plurality of first pins protruding radially inward of said corresponding one of the first plurality of passages.

11. An apparatus for use in a gas turbine engine, comprising:

a hanger having a ring shaped portion substantially centered around an axis;

an inner case having a ring shaped portion substantially centered around the axis, the ring shaped portion of the inner case positioned radially outward of the ring shaped portion of the hanger;

a seal having a ring shaped portion substantially centered around the axis, the ring shaped portion of the seal positioned radially inward of the ring shaped portion of the hanger;

means for coupling the hanger to the inner case; and, means for coupling the hanger to the seal.

12. The apparatus of claim 11, further comprising:

an outlet guide vane assembly positioned radially outward of the hanger and coupled to the inner case; and, means for transmitting torsion loads from the outlet guide vane assembly to the inner case.

13. An apparatus for use in a gas turbine engine, comprising:

a hanger having a ring shaped portion substantially centered around an axis, the ring shaped portion of the hanger including a first plurality of passages, the first plurality of passages extending substantially radially with respect to the axis;

a seal having a ring shaped portion substantially centered around the axis, the ring shaped portion of the seal positioned radially inward of the ring shaped portion of the hanger, the ring shaped portion of the seal including a plurality of orifices extending substantially radially with respect to the axis, wherein at least one of the plurality of orifices is substantially aligned with at least one of the first plurality of passages; and, a first pin extending between a first end and a second end, the first end and a first portion of the first pin positioned within said at least one of the first plurality of passages and a second portion of the first pin positioned within said at least one of the plurality of orifices to couple the hanger to the seal.

14. The apparatus of claim 13, wherein the ring shaped portion of the seal includes a pair of slots for receiving a strip to retain the pin.

15. The apparatus of claim 14, wherein the strip is substantially L-shaped.

16. The apparatus of claim 14, wherein the seal further includes a lip to retain the strip, the lip being located between the pair of slots.

17. The apparatus of claim 13, further comprising:

an inner case having a ring shaped portion substantially centered around the axis, the ring shaped portion of the inner case positioned radially outward from the ring shaped portion of the hanger, the ring shaped portion of the inner case including a plurality of openings, each of the plurality of openings extending substantially radially with respect to the axis;

a second pin extending between a first end and a second end;

wherein the ring shaped portion of the hanger includes a second plurality of passages, and wherein at least one of the second plurality of passages is substantially aligned with at least one of the plurality of openings; and, wherein the first end of the second pin is positioned within said at least one of the plurality of openings and a portion of the second pin is positioned within said at least one of the second plurality of passages to couple the inner case and the hanger together.

18. The apparatus of claim 17, further comprising:

an outlet guide vane assembly positioned radially outward of the hanger and coupled to the inner case, the outlet guide vane assembly including a bore extending substantially parallel to the axis;

wherein the inner case includes an aperture extending substantially parallel to the axis, and wherein the aperture is substantially aligned with the bore; and, a third pin positioned within the bore and the aperture to transmit torsion loads from the outlet guide vane assembly to the inner case.

* * * * *